US007909680B2

(12) United States Patent
Boeck et al.

(10) Patent No.: US 7,909,680 B2
(45) Date of Patent: Mar. 22, 2011

(54) HAND-HELD POWER TOOL WITH GUARD, IN PARTICULAR AN ANGLE GRINDER

(75) Inventors: Cornelius Boeck, Kirchheim (DE); Joachim Schadow, Leinfelden-Echterdingen (DE); Sinisa Andrasic, Schoenaich (DE)

(73) Assignee: Robert Bosch GmbH, Stutggart (DE)

( * ) Notice: Subject to any disclaimer, the term of this patent is extended or adjusted under 35 U.S.C. 154(b) by 240 days.

(21) Appl. No.: 12/279,883

(22) PCT Filed: Sep. 20, 2007

(86) PCT No.: PCT/EP2007/059969

§ 371 (c)(1), (2), (4) Date: Aug. 19, 2008

(87) PCT Pub. No.: WO2008/058793

PCT Pub. Date: May 22, 2008

(65) Prior Publication Data

US 2009/0029635 A1 Jan. 29, 2009

(30) Foreign Application Priority Data

Nov. 13, 2006 (DE) ..... 10 2006 053 304
Sep. 3, 2007 (DE) ..... 10 2007 041 840

(51) Int. Cl.
*B24B 23/00* (2006.01)
*B24B 55/04* (2006.01)

(52) U.S. Cl. ..... 451/344; 451/359; 451/451; 451/454

(58) Field of Classification Search ..... 451/344, 451/358, 359, 354, 451, 452, 454
See application file for complete search history.

(56) References Cited

U.S. PATENT DOCUMENTS

| | | | | | |
|---|---|---|---|---|---|
| 4,060,940 | A | * | 12/1977 | DeWitt | 451/358 |
| 4,574,532 | A | * | 3/1986 | Haberle et al. | 451/451 |
| 4,791,541 | A | * | 12/1988 | Simmons | 362/376 |
| 4,924,635 | A | * | 5/1990 | Rudolf et al. | 451/344 |
| 5,005,321 | A | * | 4/1991 | Barth et al. | 451/359 |
| 5,384,985 | A | * | 1/1995 | Jacobsson | 451/344 |
| 5,440,815 | A | * | 8/1995 | Inkster | 30/390 |
| 5,766,062 | A | * | 6/1998 | Edling | 451/451 |
| 6,464,573 | B1 | * | 10/2002 | Keller | 451/451 |

(Continued)

FOREIGN PATENT DOCUMENTS

DE 39 13 898 10/1990

(Continued)

*Primary Examiner* — Eileen P. Morgan
(74) *Attorney, Agent, or Firm* — Michael J. Striker

(57) ABSTRACT

The invention relates to a portable power tool for a rotating, preferably disk-shaped tool (12). Said portable power tool comprises a machine housing (14), having a flange (16, 160) or a machine neck, and a protective hood (18) that can be detachably tensioned on the machine neck to cover the tool (12) or that has a protective hood neck (20) or protective hood collar that annularly carries a tightening strap (22). Said strap can be tightened by tensioning means (24). An anti-rotation lock effective between the machine neck and the protective hood (18) is interposed between the protective hood (18) and the machine neck in the form of a profiled structure (26). The invention is characterized in that the tensioning means (24), in its tensioned position, can be connected several times in a form fit to the machine neck and in its detached positioned is no longer connected in a form fit to the machine neck.

10 Claims, 12 Drawing Sheets

U.S. PATENT DOCUMENTS

| | | | | |
|---|---|---|---|---|
| 6,669,544 | B1 * | 12/2003 | Walz et al. | 451/454 |
| 6,699,114 | B1 * | 3/2004 | Booeshaghi et al. | 451/451 |
| 6,893,334 | B1 * | 5/2005 | Stivers | 451/359 |
| 6,949,017 | B2 * | 9/2005 | Koschel et al. | 451/358 |
| 6,988,939 | B2 * | 1/2006 | Hofmann et al. | 451/344 |
| 7,063,606 | B2 * | 6/2006 | Stierle et al. | 451/359 |
| 7,311,589 | B2 * | 12/2007 | Wiker | 451/451 |
| 2004/0014412 | A1 * | 1/2004 | Hofmann et al. | 451/451 |
| 2006/0052041 | A1 * | 3/2006 | Wiker | 451/451 |

FOREIGN PATENT DOCUMENTS

| | | |
|---|---|---|
| DE | 101 24 439 | 11/2002 |
| DE | 102 59 520 | 7/2004 |
| EP | 0 812 657 | 12/1997 |

* cited by examiner

HAND-HELD POWER TOOL WITH GUARD, IN PARTICULAR AN ANGLE GRINDER

CROSS-REFERENCE TO A RELATED APPLICATION

The invention described and claimed hereinbelow is also described in German Patent Applications DE 10 2006 053 304.6 filed on Nov. 13, 2008 and DE 10 2007 041 840.1 filed on Sep. 3, 2007. These German Patent Applications, whose subject matter is incorporated here by reference, provide the basis for a claim of priority of invention under 35 U.S.C. 119(a)-(d).

BACKGROUND OF THE INVENTION

The present application is related to a hand-held power tool with a guard.

An angle grinder with an adjustable guard is made known in EP 0 812 657 A1. In that case, the guard is adjustable in a rotating manner on a connection piece of a flange of the angle grinder, and is supported such that it may be detachably attached using a single form-fit locking means. The spindle of the angle grinder passes through the center of the flange. A cutting and/or grinding disk is installed on the free end of the spindle in a clampable, rotationally drivable manner for cutting and machining work pieces, which are partially enclosed by the guard. The guard must be positioned in a rotationally adjustable manner on the hand-held power tool such that the region of the grinding disk that faces the user is enclosed by the guard. At the same time, a region of the grinding disk that points away from the user extends past the flange, radially relative to the work piece engagement.

SUMMARY OF THE INVENTION

The present invention relates to a hand-held power tool for a rotating, preferably disk-shaped tool, with a machine housing that includes a flange and/or a machine neck, and with a guard that is detachably clampable to the machine neck, for covering the tool, and that includes a guard neck and/or a guard collar with an annular clamping band that may be tightened using a clamping means, and with an anti-rotation lock being located between the guard and the machine neck that is designed as a profiled structure and acts between the machine neck and the guard.

It is provided that the clamping means, in its clamping position, may be connected repeatedly and in a form-fit manner with the machine neck and, in its release position, is disengaged from the form-fit connection with the machine neck. The result is to advantageously ensure a secure connection between the guard and the machine neck of the machine housing that may withstand strong loads that occur during a working process. The guard is preferably prevented from rotating via the profiled structure during operation of the hand-held power tool, thereby ensuring that the guard safely protects the operator, in particular if the tool—a grinding disk, in particular—should burst. The guard may be used in general with hand-held power tools that include a rotating, preferably disk-shaped tool, such as a grinding disk, a cutting disk, and/or a polishing disk, and is usable—particularly advantageously—with an angle grinder.

In this context, a "flange and/or a machine neck" refers to a region of the hand-held power tool that serves to accommodate and/or attach the guard to the hand-held power tool, and that encloses the tool at least partially. This flange and/or machine neck may be designed as a single piece with the hand-held power tool, or it may be designed as a separate component. A "guard connection piece and/or guard collar" located on or integrally formed with the guard preferably refers, in this context, to a region that preferably extends perpendicularly to a main extension plane of the guard, which is provided for attachment with the hand-held power tool and/or for placement on a subregion of the hand-held power tool, in particular on a flange and/or machine neck of the hand-held power tool. This guard connection piece and/or guard collar is advantageously designed as a single piece with a body of the guard. In this context, a "clamping band" refers to a band, and particularly advantageously to a metal band, that bears around a subregion of the guard, e.g., a guard connection piece, in particular in order to attach the guard to the hand-held power tool, and that encloses the subregion in a non-positive and/or form-fit manner with a clamping force in particular. A "clamping means" refers, in particular, to a means that reduces a circumference, in particular of the clamping band, using a clamping process, e.g., the folding down of a lever, the tightening of a screw, or by using another process that appears suitable to one skilled in the technical art. A "profiled structure" refers, in particular, to a shape, e.g., a perforated structure, an edge, and/or an internal pressed-out region, that includes a profile and/or a contour whose geometry depends on a function of the anti-rotation lock. Another type of anti-rotation lock that appears reasonable to one skilled in the art is also feasible, however. In this context, a "clamping position" refers to a position of the clamping band in which the clamping band enters into a connection with a further component that is under mechanical tension, in particular, e.g., a connection based on a form fit, e.g., with the flange and/or the machine neck of the hand-held power tool in particular. A released position therefore refers to a position of the clamping band in which a clamped connection between the clamping band and the further component has been released.

Further advantages result from the description of the drawing, below. Exemplary embodiments of the present invention are shown in the drawing. The drawing, the description, and the claims contain numerous features in combination. One skilled in the art will also advantageously consider the features individually and combine them to form further reasonable combinations.

DESCRIPTION OF THE PREFERRED EMBODIMENTS

Figure 1:
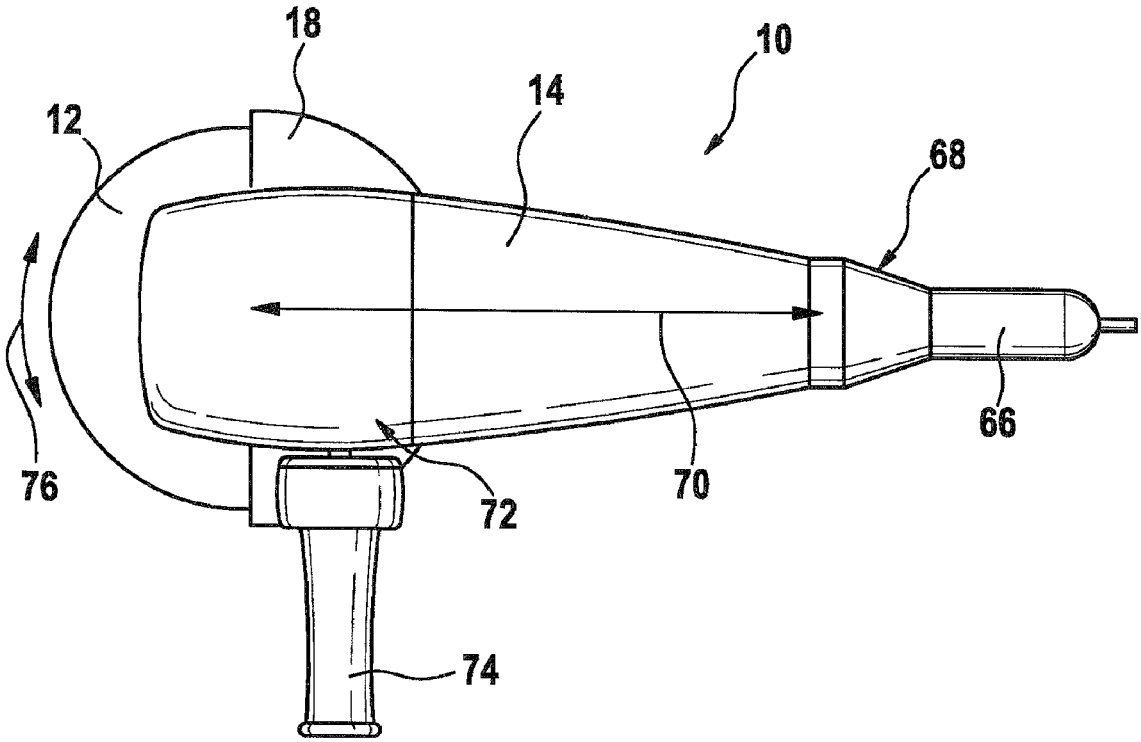
FIG. 1 shows an inventive hand-held power tool with a guard, in a schematic depiction.

A hand-held power tool 10 designed as an angle grinder is shown in FIG. 1, in a top view. The angle grinder includes a machine housing 14 and a main handle 66, which is integrated in machine housing 14. Main handle 66 extends on a side 68—that faces away from tool 12 designed as a cutting disk—in a longitudinal direction 70 of the angle grinder. An auxiliary handle 74 is located in a front region 72 of the angle grinder that is close to the tool, and it extends transversely to longitudinal direction 70 of the angle grinder. To protect an operator, hand-held power tool 10 includes a guard 18, which encloses tool 12 at least partially in a circumferential direction 76 of tool 12.

Figure 2A:
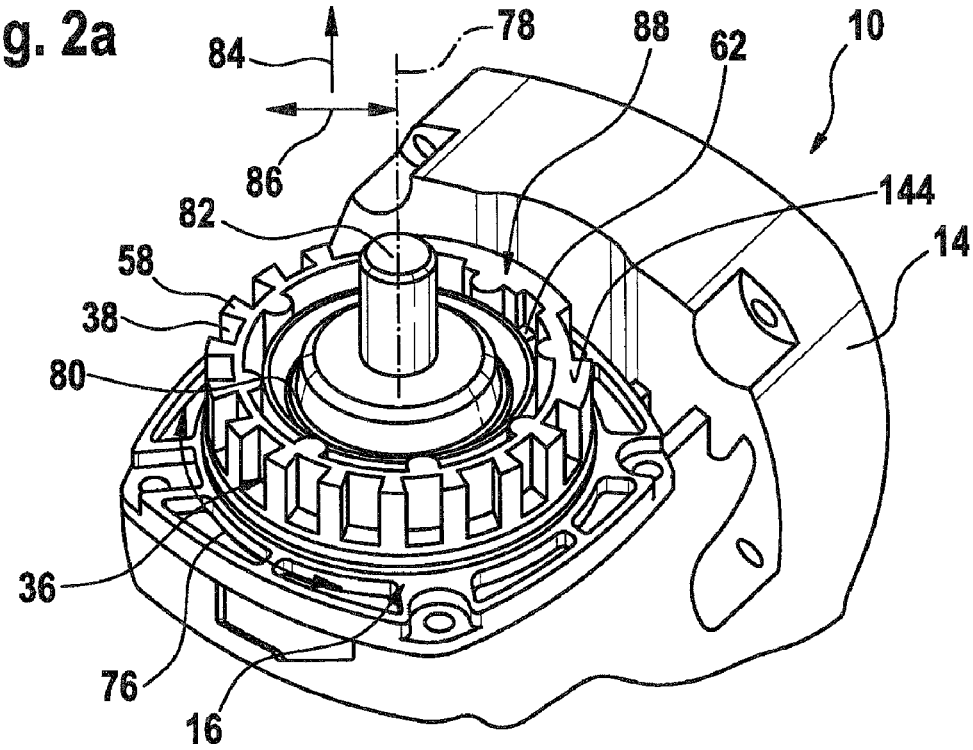
FIGS. 2*a*, 2*b* show a subregion of the hand-held power tool with a machine housing and a machine neck, in two different perspective views.
Figure 2B:
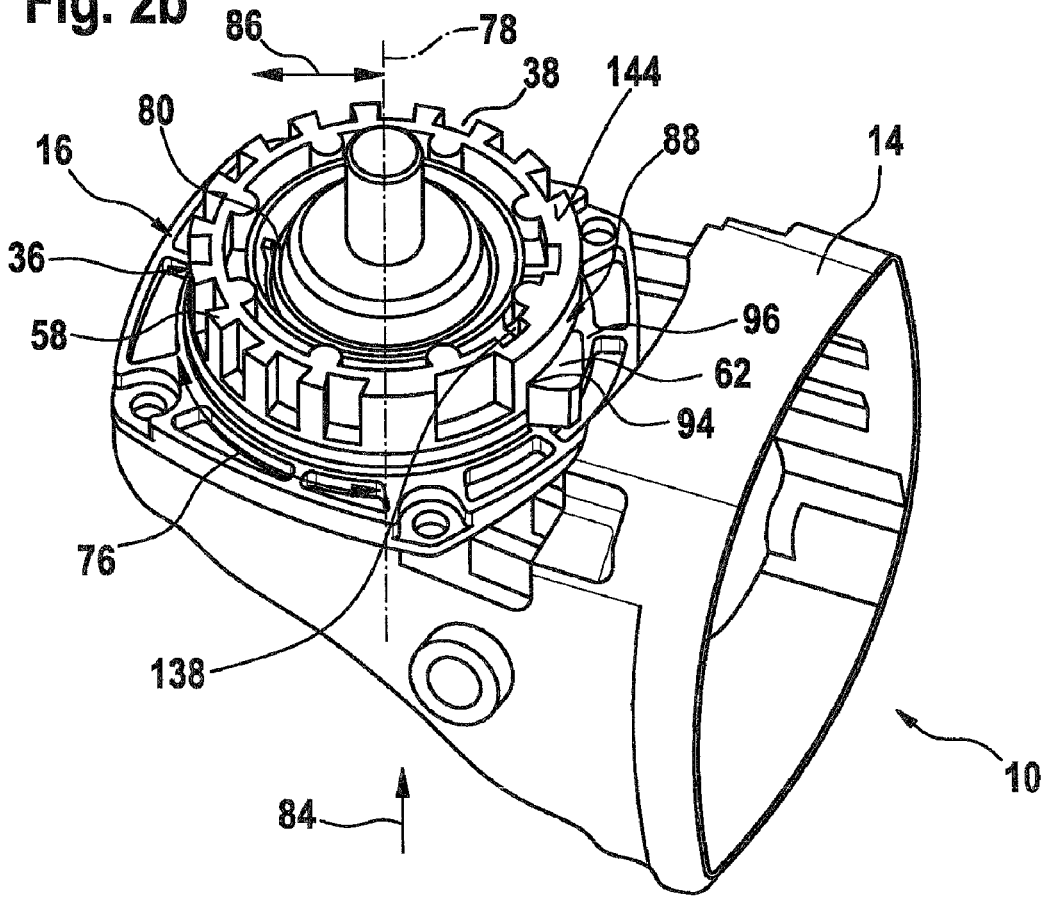

FIGS. 2*a* and 2*b* show a subregion of hand-held power tool 10 and/or machine housing 14 facing tool 12, with a spindle 82, which is rotatable around spindle axis 78. During operation of hand-held power tool 10, spindle 82 transfers a drive torque from a not-shown motor of hand-held power tool 10 to tool 12. To this end, the subregion includes a flange 16, which is designed as a machine neck, and which is fixedly connected with machine housing 14. Flange 16 includes a circular recess 80 in the center, in the region of spindle 82, through which spindle 82 is guided when flange 16 is installed in machine housing 14. Spindle 82 extends in an axial direction 84—which extends perpendicularly to longitudinal direction 70 of hand-held power tool 10—and beyond flange 16. Flange 16 has a toothed profile, which extends outwardly in a radial direction 86, and which includes teeth 58—which extend outwardly in radial direction 86—and recesses 38 and/or tooth gaps, which extend inwardly in radial direction 86. The teeth are also designed in the manner of puzzle pieces, and/or such that they are undercut inwardly in radial direction 86 (refer also to FIGS. 2*a* through 3*b*). The toothed profile is provided as a counter-toothed profile 36 for coupling with a matching toothed profile 34 of guard 18 (see FIGS. 5*a*, 5*b*, and 5*c*). Counter-toothed profile 36 extends in circumferential direction 76 around a range of approximately 270° (FIGS. 2, 2*b*, 3*a*, and 3*b*).

Figure 3A:
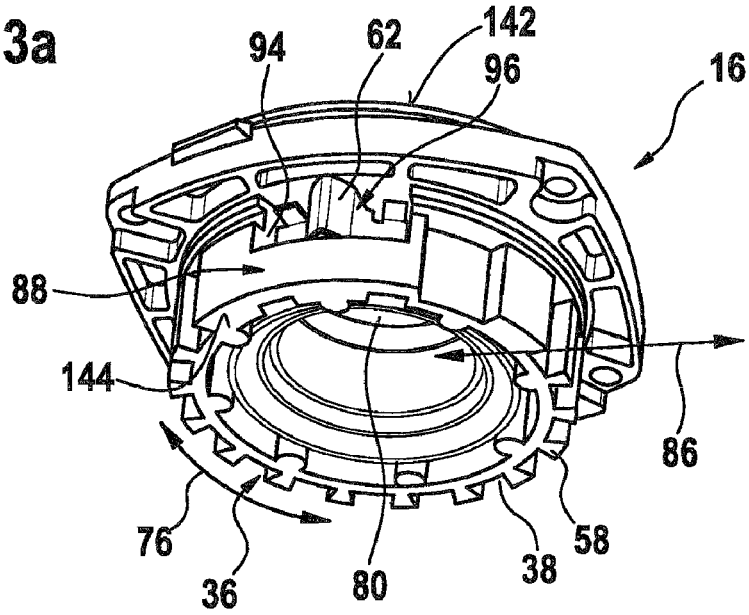
FIGS. 3*a* and 3*b* show the flange with an orientation spring, in two different views.
Figure 3B:
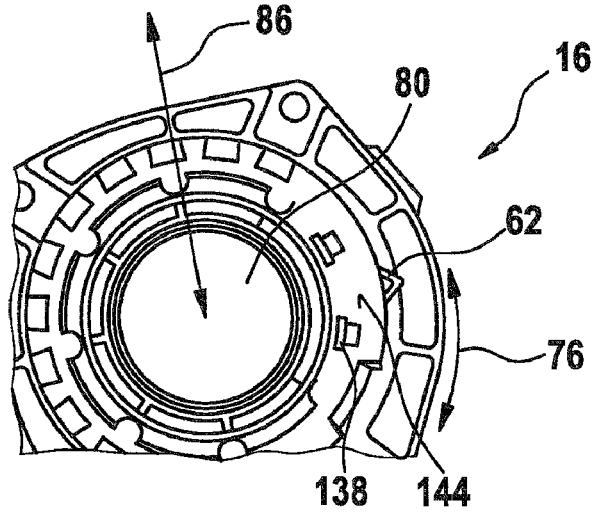
Figure 4:
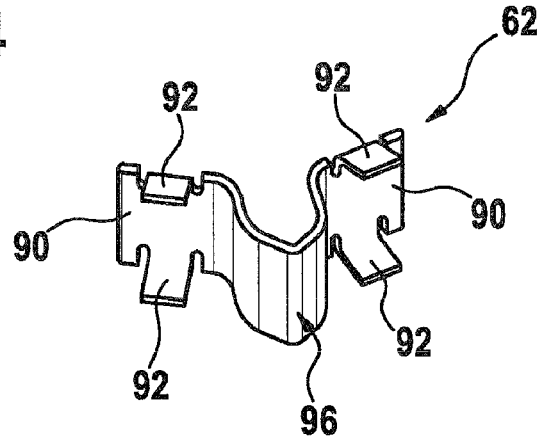
FIG. 4 shows the orientation spring in a perspective view.

An orientation spring 62 is located in a region 88 of flange 16 that has a smooth contour and does not have a toothed profile in circumferential direction 76. Orientation spring 62 serves to establish an exactly defined insertion position of guard 18 relative to flange 16 when guard 18 is installed. To this end, orientation spring 62 is designed as a bent spring-steel lamella. To support orientation spring 62 on flange 16, orientation spring 62 includes two bearing elements 92 in end regions 90. Bearing elements 92 are located in end regions 90 of orientation spring 62 such that they extend outwardly in radial direction 86 (see FIGS. 3*a* and 4). For placement inside flange 16, flange 16 includes a recess 94 that extends in circumferential direction 76 and has a length that corresponds to a length of orientation spring 62 (FIG. 3*a*). Via bearing elements 92, orientation spring 62 bears inside recess 94 of flange 16. Bearing elements 92 extend through recesses 138 on an underside 142 and a top side 144 of flange 16, thereby ensuring that orientation spring 62 will not drop out of flange 16 (FIGS. 2*a*, 2*b*, and 3*b*). Orientation spring 62 has a U shape in a central subregion 96. U-shaped subregion 96 extends radially outwardly (FIGS. 2*b*, 3*a*, and 4). When orientation spring 62 is installed, U-shaped subregion 96 extends radially outwardly beyond a smooth, profile-free region 88 of flange 16 (FIGS. 2*b* and 3*a*).

Figure 5A:
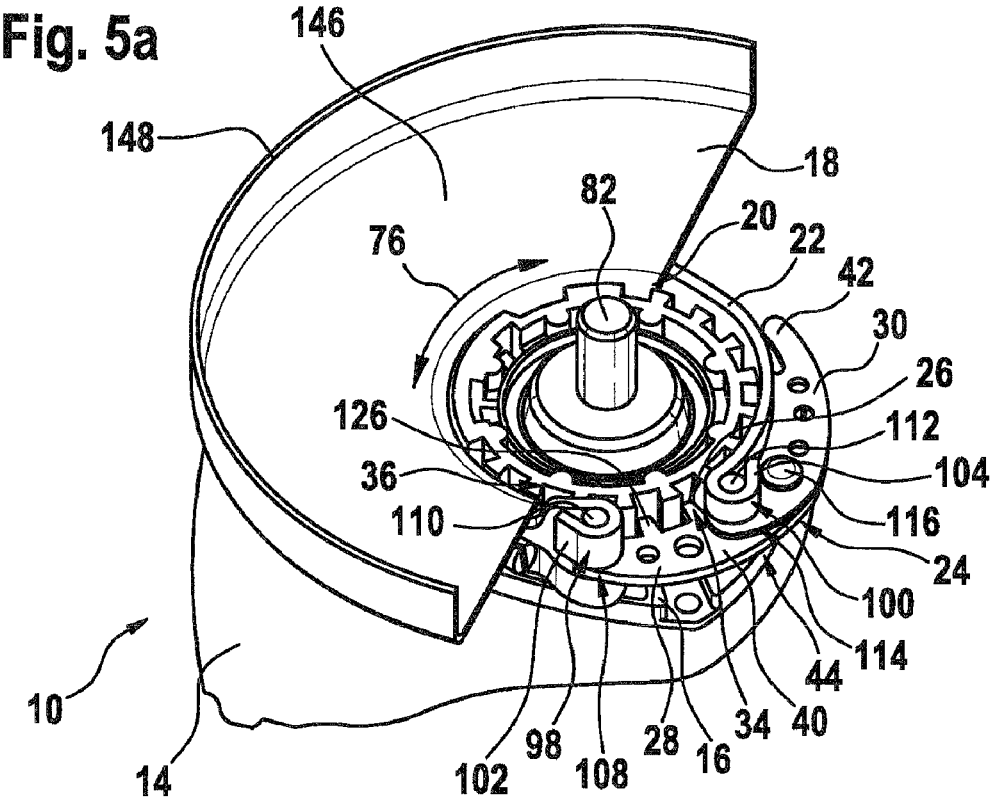
FIGS. 5*a*, 5*b* show the subregion of the hand-held power tool with the machine housing and the installed guard (FIG. 5*a*), and a detailed view of a fastening region (FIG. 5*b*), in perspective views.
Figure 5B:
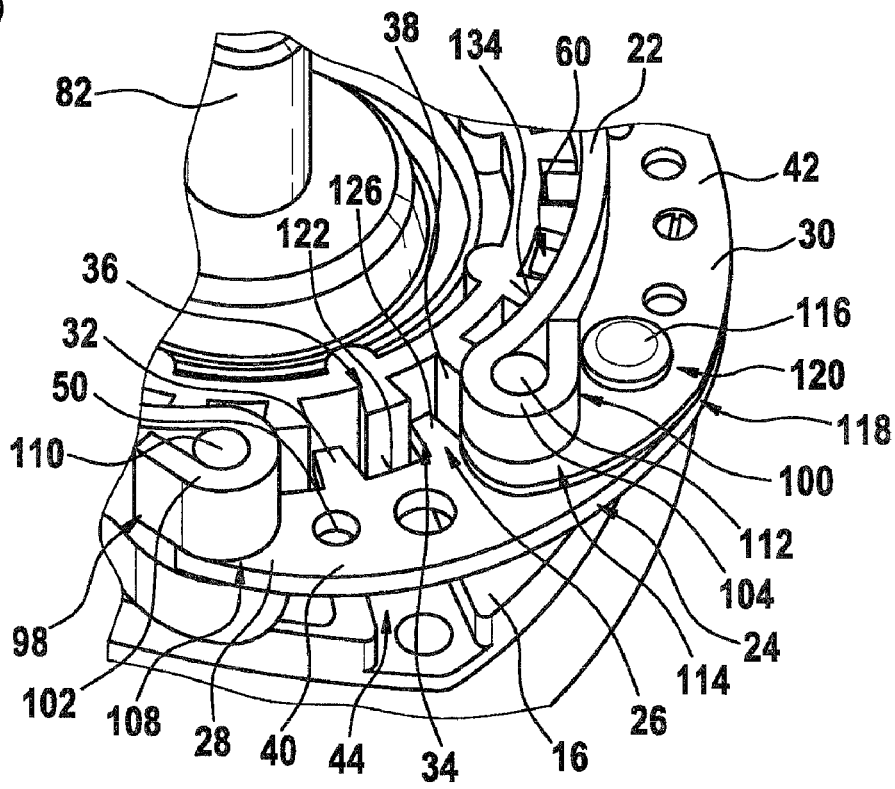
Figure 6:
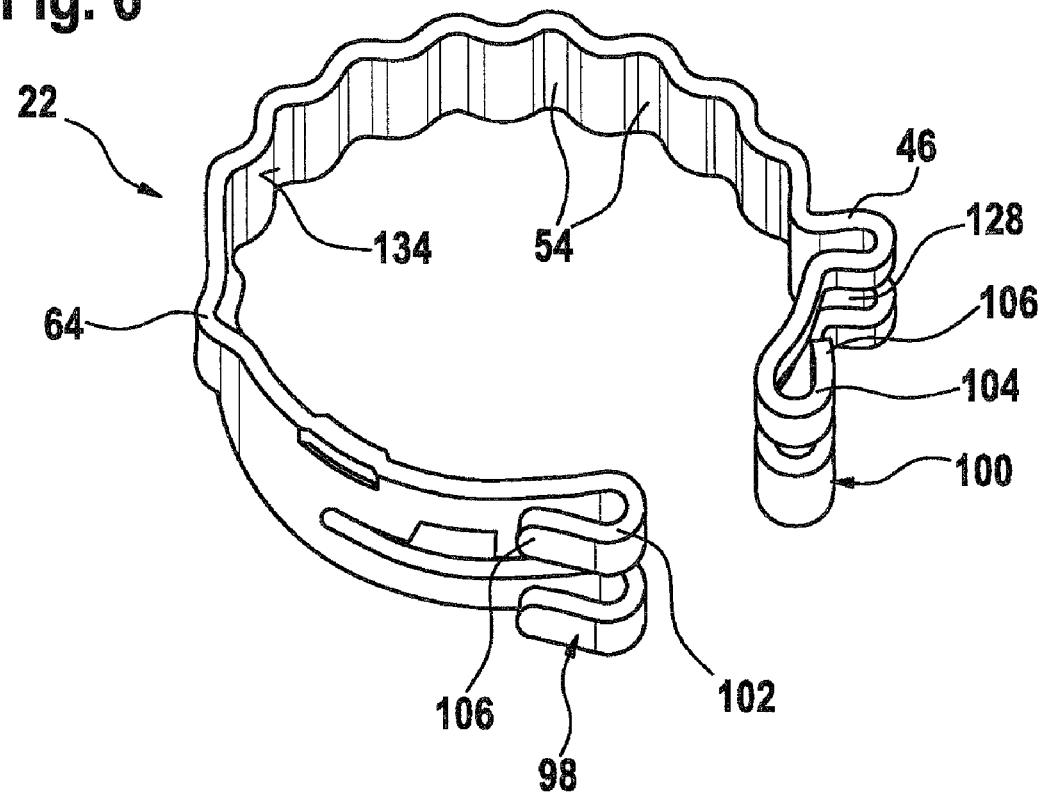
FIG. 6 shows the clamping band in a perspective view.

FIGS. 5*a* and 5*b* show hand-held power tool 10 with a guard 18 installed on flange 16. Guard 18 is located on flange 16 such that it may be detached easily without the use of auxiliary tools and such that it is adjustable in a rotating manner. Guard 18 includes a disk-shaped body 146, which extends around a partial circle of approximately 180° of tool 12 in circumferential direction 76, and which is centered around spindle 82. Guard 18 includes a guard connection part 20, which is designed as a guard collar. A clamping band 22 is located around guard connection part 20. Clamping band 22 may be tightened using clamping means 24, thereby forming an anti-rotation lock between flange 16 and guard 18 via a profiled structure 26. To attach guard 18 to flange 16, end regions 98, 100 of clamping band 22 are bend outwardly in circumferential direction 76 and forms tabs 102, 104, which are rotation point eyelets, and which are provided for positioning clamping means 24 relative to clamping band 22 (FIG. 6). An inwardly bent design of tabs 102, 104, i.e., bent from the outside toward the inside, reduces and/or prevents tabs 102, 104 from being bent upward when loads are applied (FIGS. 5*a*, 5*b* and 6). By attaching (e.g., via welding, riveting, etc.) ends 106 of tabs 102, 104 with clamping band 22, they are prevented from accidentally becoming expanded. It is also basically feasible for ends 106 of tabs 102, 104 to be unattached. Combined with clamping band 22, unattached ends 106 of tabs 102, 104 provide clamping band 22 with spring action. Tabs 102, 104 of clamping band 22 may also be designed merely as bent, as bent and secured against expansion, or as bent from the outside toward the inside.

Clamping means 24—when in a clamped position—may be connected repeatedly and in a form-fit manner with flange 16, which is designed as the machine neck (FIGS. 5*a* and 5*b*). In a release position, clamping means 24 are not in a form-fit connection with flange 16. Clamping means 24 are composed of clamping levers 28, 30, which form a toggle joint system 44. Clamping levers 28, 30 are designed as a rocker 40 and a latch 42. Rocker 40 is supported in circumferential direction 76 with an end region 108—which faces away from latch 42—via a bearing bolt 110 in tab 102 of clamping band 22 such that it is movable around a rotation axis, which extends parallel with and/or coaxial with bearing bolt 110. Latch 42 is supported in tab 104 using a further bearing bolt 112 via an end region 114, which faces rocker 40, such that it is rotatable around an axis of bearing bolt 112. Via a bearing element 116, rocker 40 and/or an end region 118—which faces latch 42—of rocker 40 and a region 120 of latch 42 are supported such that they are rotatable relative to each other. Region 120 of latch 42 is located after end region 114, which serves as support in tab 104 of clamping band 22, along latch 42 in a direction facing away from rocker 40. Three rotation points of toggle joint system 44 are formed by bearing bolts 110, 112 and/or bearing element 116. When latch 42 is closed, the rotation point of the connection of rocker 40 with latch 42 is moved from latch 42 in the direction of rocker 40 in front of the rotation point of latch 42 with tab 104 of clamping band 22, thereby overcoming a dead point of toggle joint system 44, and latch 42 automatically returns to its clamping position. This takes place in a snap-in manner that is audible to the operator. An additional type of detent action, e.g., between tab 102 and rocker 40, is also feasible, of course, to provide additional security. Forces of expansion and/or strain that occur, or motions that occur on clamping band 22 during operation of the hand-held power tool amplify the closing forces on rocker 40 and latch 42 that aim to further tighten toggle joint system 44. A closing force increases with the forces of expansion and/or strain (FIGS. 5*a* and 5*b*).

Figure 7A:
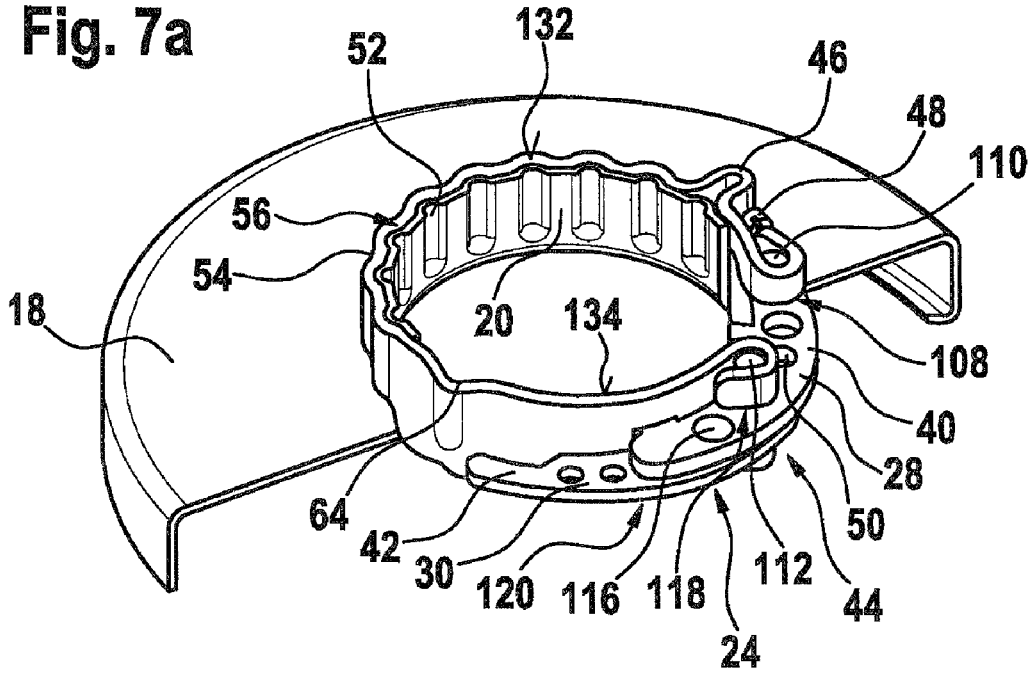
FIGS. 7*a*, 7*b*, 7*c* show the guard with a clamping band and a toggle joint system in a clamping position (FIGS. 7*a*, 7*c*) and in a release position (FIG. 7*b*), both in perspective views.
Figure 7B:
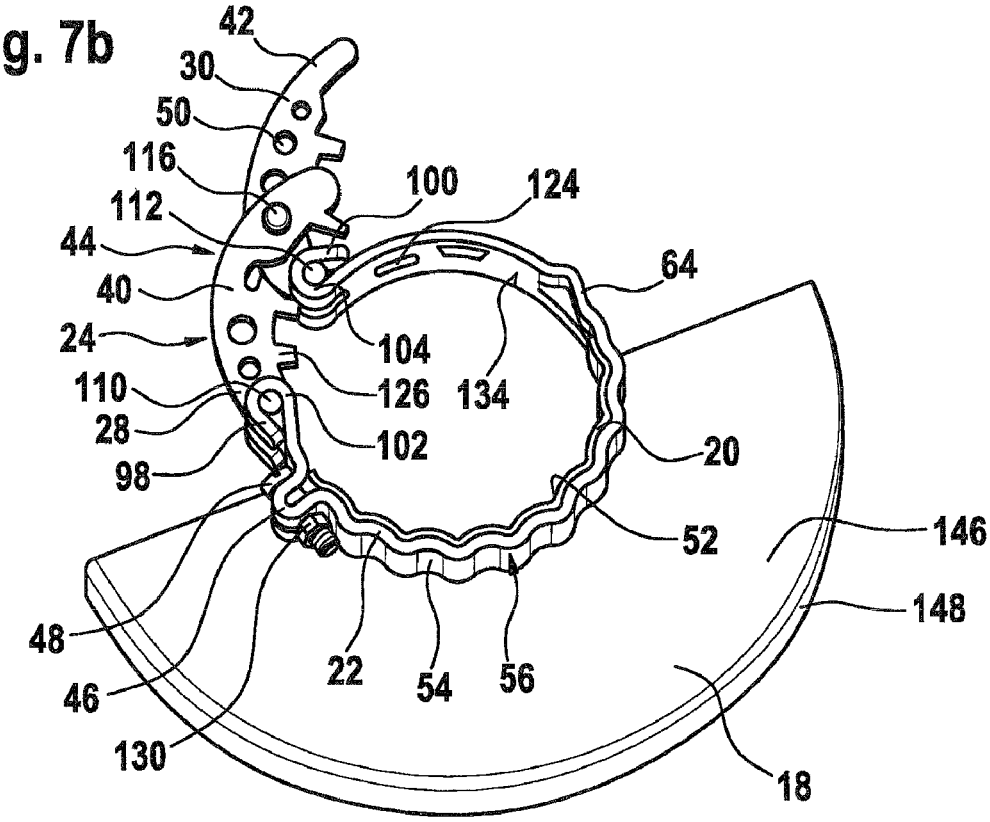
Figure 7C:
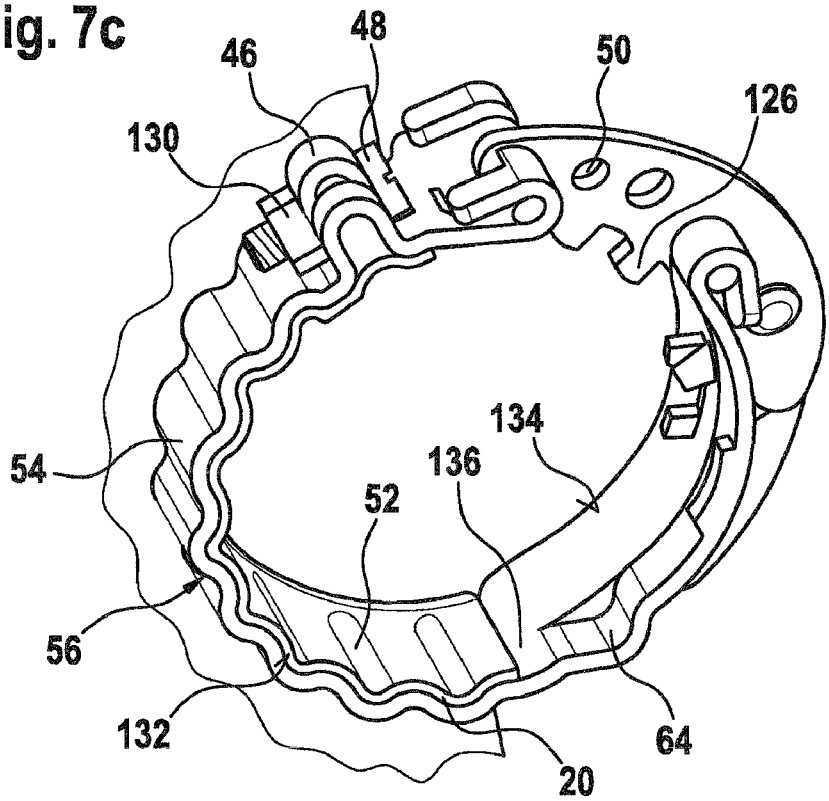

Rocker 40 and latch 42 include undercut-engagement means 32, 60 that are formed by a toothed profile 34, which, together with counter-toothed profile 36 of flange 16, forms profiled structure 26. Toothed profile 34 is provided for engagement in counter-toothed profile 36 and/or in recesses 38 of flange 16 to establish a non-rotatable, form-fit connection between guard 18 and flange 16. Undercut-engagement means 32, 60 and/or toothed profile 34 are/is located on a side 122 of latch 42 and/or rocker 40 facing flange 16. Rocker 40 includes three undercut-engagement means 32, and latch 42 includes two undercut-engagement means 60 (FIG. 7*c*). Undercut-engagement means 32 of rocker 40—which face latch 42—engage, in a clamping position, in the same recess 38 of counter-toothed profile 36 as do undercut-engagement means 60 of latch 42, which face rocker 40. Any other distribution of undercut-engagement means 32, 60 that appears reasonable to one skilled in the technical art is also feasible, however. In addition, clamping band 22 includes a recess 124 in the region of latch 42 (FIG. 7*b*) that extends in circumferential direction 76 on clamping band 22.

Undercut-engagement means 60 of latch 42 extend through recess 124 and form, together with counter-toothed profile 36 of flange 16, a form-fit connection when in a clamping position (FIGS. 5*a* and 5*b*). Instead of one recess 124, it is also possible to provide several recesses in clamping band 22, each of which is provided for only one tooth 126 of toothed profile 34 of latch 42. To establish a form-fit connection, a width of teeth 126 of toothed profile 34 is matched to a width of recesses 38 of counter-toothed profile 36. Rocker 40 and latch 42 are also provided with holes 50, to reduce weight. One or more of the undercut-engagement means 32, 60 may also be designed to move sooner than do the other undercut-engagement means 32, 60 when a load is applied, so that they contact flange 16 sooner. An angle of contact surfaces of undercut-engagement means 32, 60 and recesses 38 in faster-moving undercut-engagement means 32, 60 is designed such that, if tool 12—in particular a grinding or cutting disk—should burst, faster-moving undercut-engagement means 32, 60 act in a tightening manner, thereby providing an operator with maximum protection during operation of hand-held power tool 10.

Guard 18 may be locked in a fixed position on flange 16 via toothed profile 34, which engages in counter-toothed profile 36 of flange 16 when guard 18 is installed. In addition, an operator may select an installation position in circumferential direction 76 that provides him with maximum protection. Given that counter-toothed profile 36 of flange 16 is limited in circumferential direction 76 to a range of approximately 270°, counter-toothed profile 36 serves as a coding means, thereby ensuring that guard 18 is not installed on flange 16 in a non-permitted position and preventing toggle joint system 44 from closing in region 88 that does not have a counter-toothed profile 36.

If tool 12 should burst, airborne tool particles act forcefully on a guard edge 148 and guard 18. Pulling and rotational forces therefore act on guard 18, but guard 18 is prevented from rotating due to the form-fit connection between clamping means 24 and flange 16. In addition, the pulling forces on guard 18 and clamping band 22 act radially outwardly, thereby causing latch 42 and rocker 40 and/or toothed profile 34 to engage more tightly in recesses 38 and/or counter-toothed profile 36 of flange 16, thereby creating a lock that acts dynamically with increasing strength and serves as a highly effective anti-rotation lock.

A closing force and/or clamping force of clamping band 22 together with clamping means 24 may also be adjusted by an operator. A clamping band length may therefore also be adjusted, e.g., to compensate for production tolerances. To this end, clamping band 22 includes a semi-loop 46, which is realized in circumferential direction 76 by a contour of clamping band 22 that is bent radially outwardly and then radially inwardly (FIGS. 6, 7*a*, and 7*b*). Semi-loop 46 includes a recess 128 through which an adjusting element in the form of a screw 48 extends, and which is tightened with a nut 130. The more tightly nut 130 is screwed onto screw 48, the narrower a clamping band diameter becomes and the greater the clamping force becomes. Further designs of clamping band 22 that deviate geometrically from semi-loop 46 are possible, e.g., a two-pieced design of clamping band 22 with two clamping band elements that may be connected with each other using the adjusting element, thereby adjusting a clamping force and/or a clamping band diameter. The adjustability may also be influenced by a number of adjusting elements and/or a design of the adjusting elements and/or a position of the adjusting elements. Clamping band 22 is located such that it is unexpandable on guard connection piece 20 around a range of 180°. It may also be attached via a subregion of only, e.g., 90°, however, which leaves the remaining subregion of clamping band 22 exposed, thereby allowing it to expand. Clamping band 22 may also be fixed in position at only one point.

Figure 8:
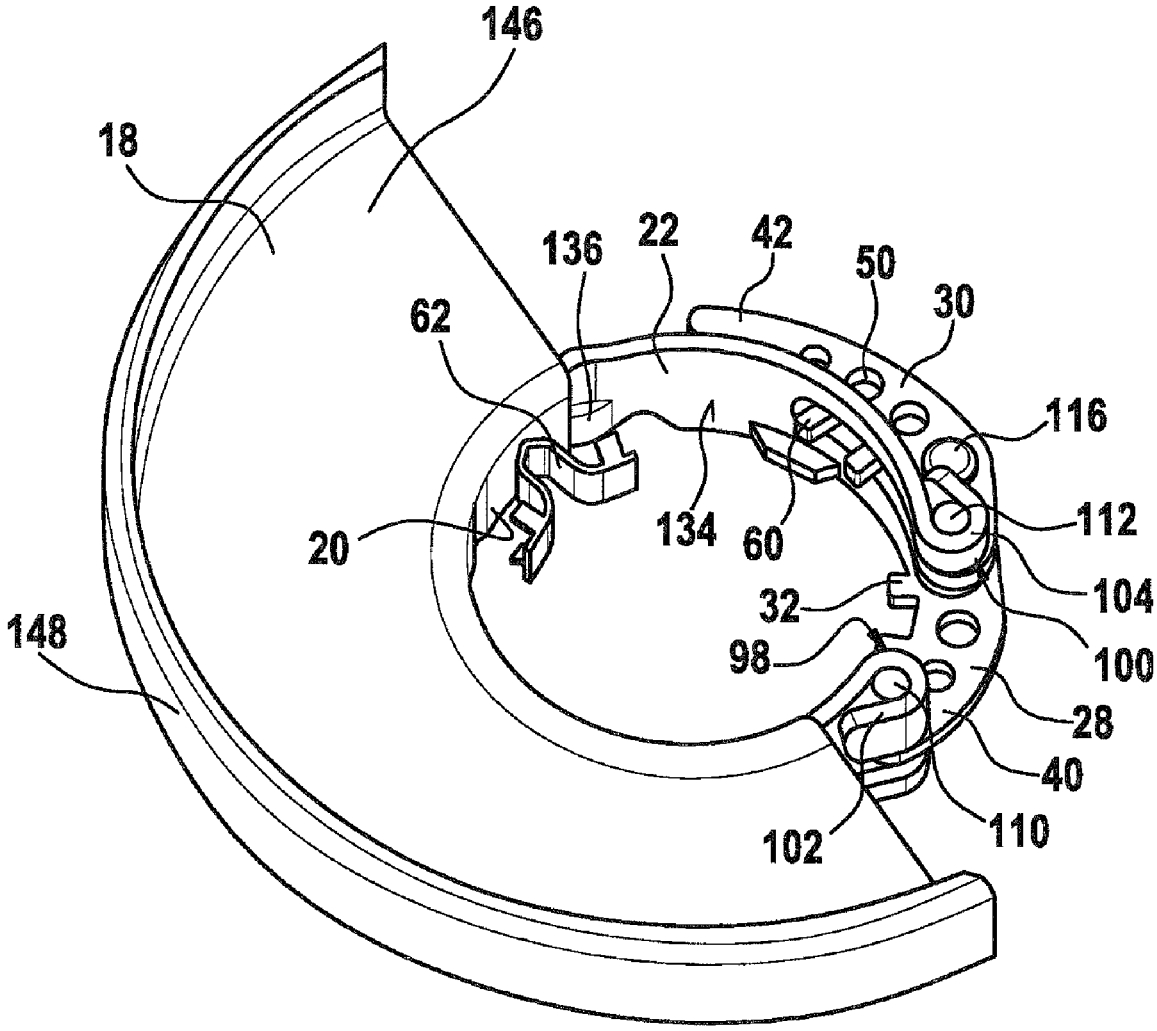
FIG. 8 shows the guard with the orientation spring, in a perspective view.

FIGS. 7*a*, 7*b*, and 7*c* show guard 18 with clamping band 22 and clamping means 24 in a clamping position (FIGS. 7*a* and 7*c*) and in a release position (FIG. 7*b*). Guard connection piece 20 of guard 18, which is enclosed by clamping band 22 on a radially outwardly directed surface 132, includes pressed-out regions 52 shaped as a wavy profile or a ring gear that extend perpendicularly to circumferential direction 76. Accordingly, a region 56 of clamping band 22 adjacent to guard connection piece 20 includes pressed-out regions 52 shaped as a wavy profile or a ring gear (FIG. 6). A simpler geometric design of clamping band 22 is also feasible, however, e.g., a contour in particular that does not include an additional stamped profile. Ring gear-type pressed-out regions 52 of guard connection piece 20 have the main function of snapping into place in a rotational lock manner with orientation spring 62 when guard is intentionally displaced (FIG. 8). When guard 18 is rotated, orientation spring 62 moves out of one pressed-out region 52 and snaps in place in the next pressed-out region 52. In addition, pressed-out regions 52 correspond with counter-toothed profile 36 of flange 16 and form a positioning aid, in particular a coded positioning aid. A V-shaped indentation 64 at a defined point in clamping band 22 is assigned to orientation spring 62 installed in flange 16 (FIG. 6). Guard 18 may be inserted when installed with flange 16 only when orientation spring 62 engages in indentation 64 in clamping band 22. To ensure that, when guard 18 is subsequently rotated on flange 16, orientation spring 62 transitions in a gliding manner from clamping band 22 to guard connection piece 20, a continually rising lamella indentation 136 is provided on a radially inwardly directed side 134 of clamping band 22 that ensures that orientation spring 62 may deviate radially inwardly in a gentle, over-latching manner.

Figure 9A:
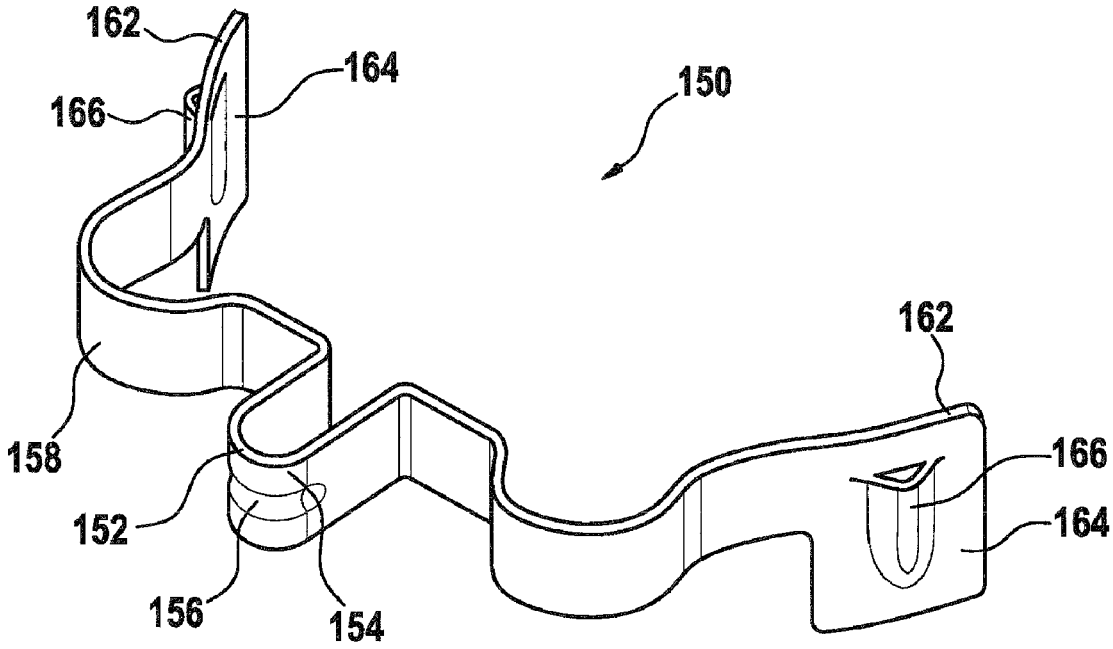
FIGS. 9*a*, 9*b* show an alternative design of the orientation spring in a perspective view (FIG. 9*a*) and in a top view (FIG. 9*b*)
Figure 14:
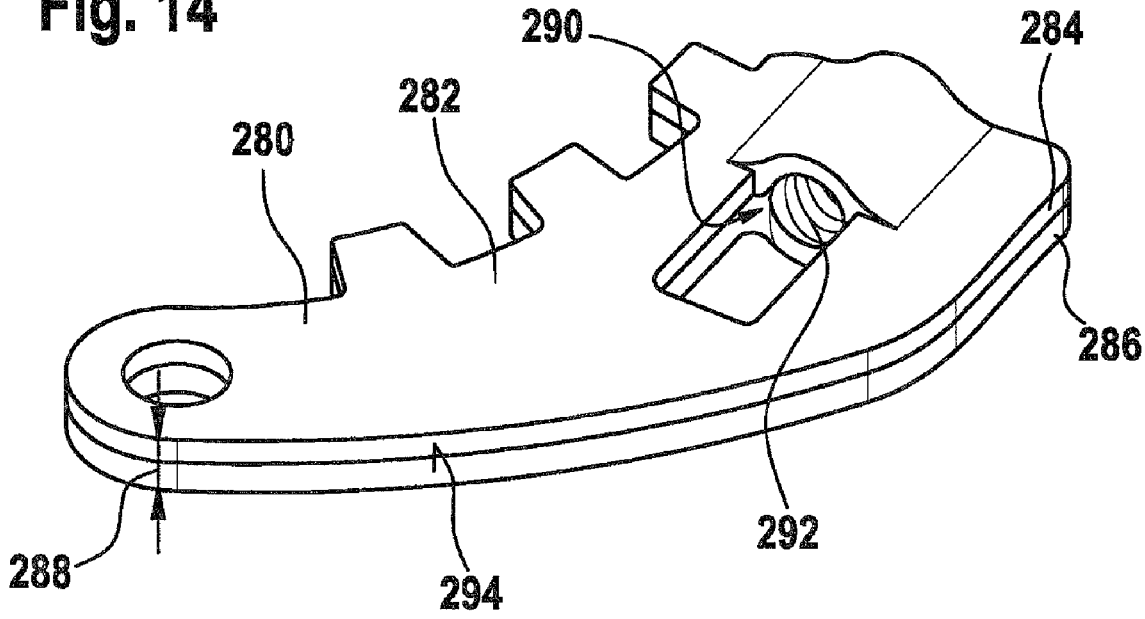
FIG. 14 shows a further design of the rocker, in a perspective view.

Alternative exemplary embodiments are shown in FIGS. 9*a* and 14. Components, features, and functions that are essentially the same are labelled with the same reference numerals. The description below is essentially limited to the differences from the exemplary embodiment in FIGS. 1 through 8. With regard for the components, features, and functions that remain the same, reference is made to the description of the exemplary embodiment in FIGS. 1 through 8.

Figure 9B:
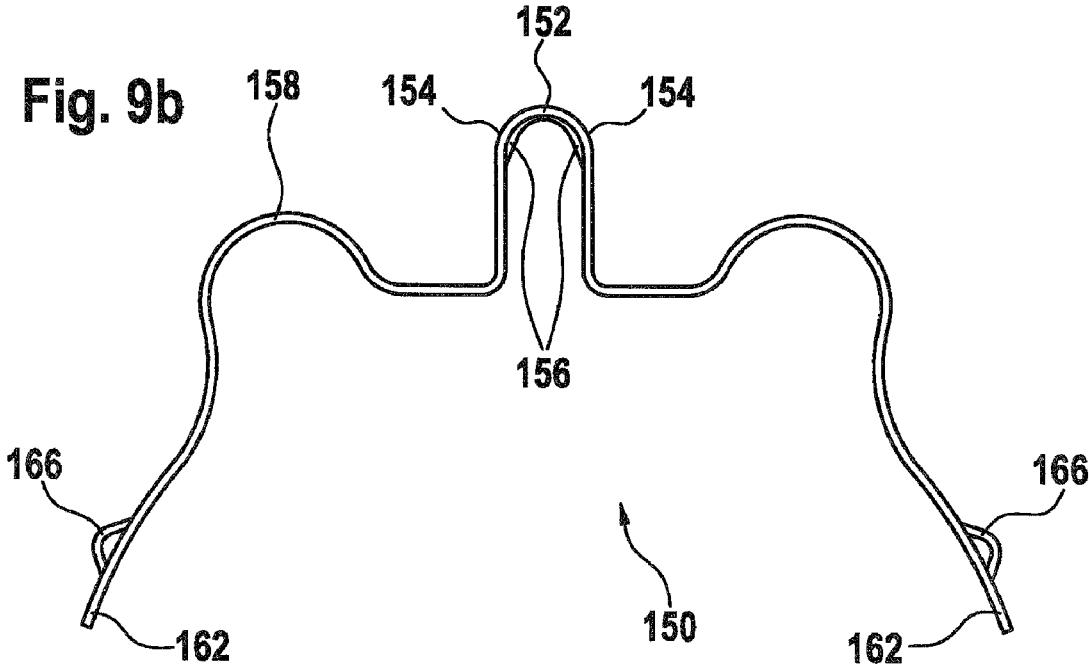
Figure 10A:
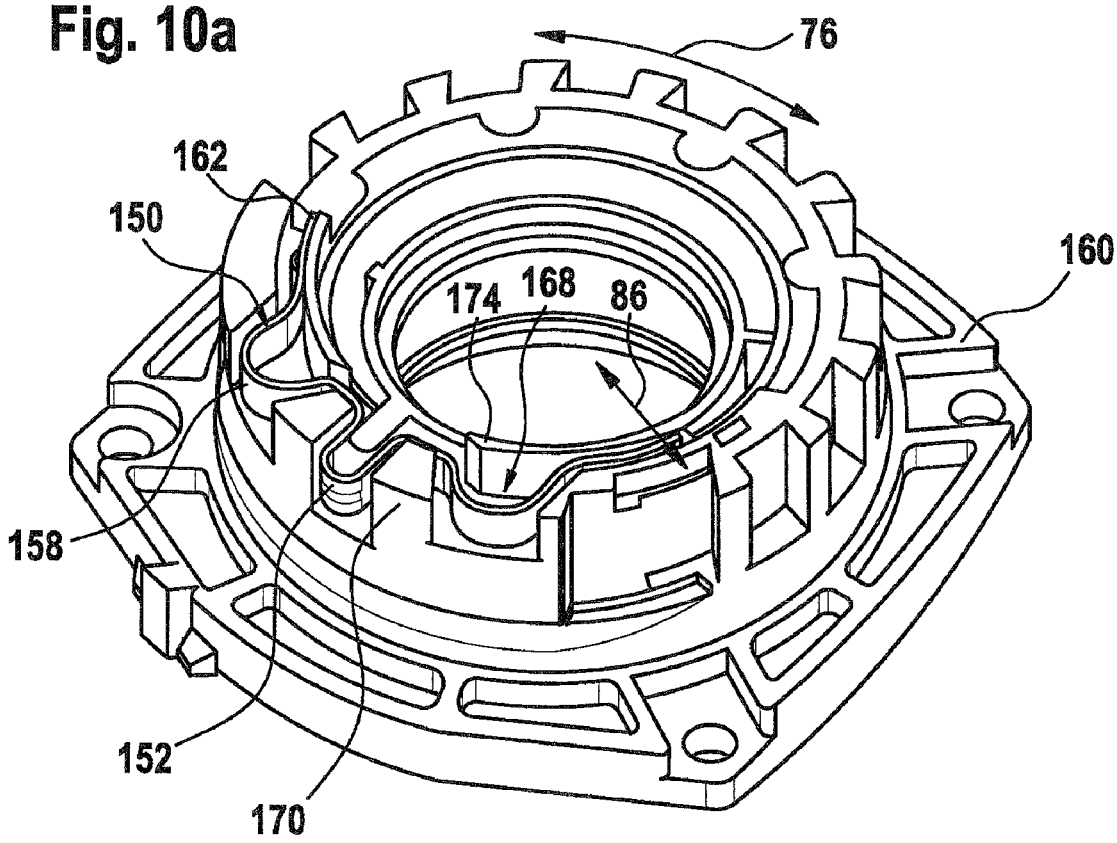
FIGS. 10*a*, 10*b* show the orientation spring in FIGS. 9*a* and 9*b* located inside a flange, in a perspective view (FIG. 10*a*), and in a top view (FIG. 10*b*)
Figure 10B:
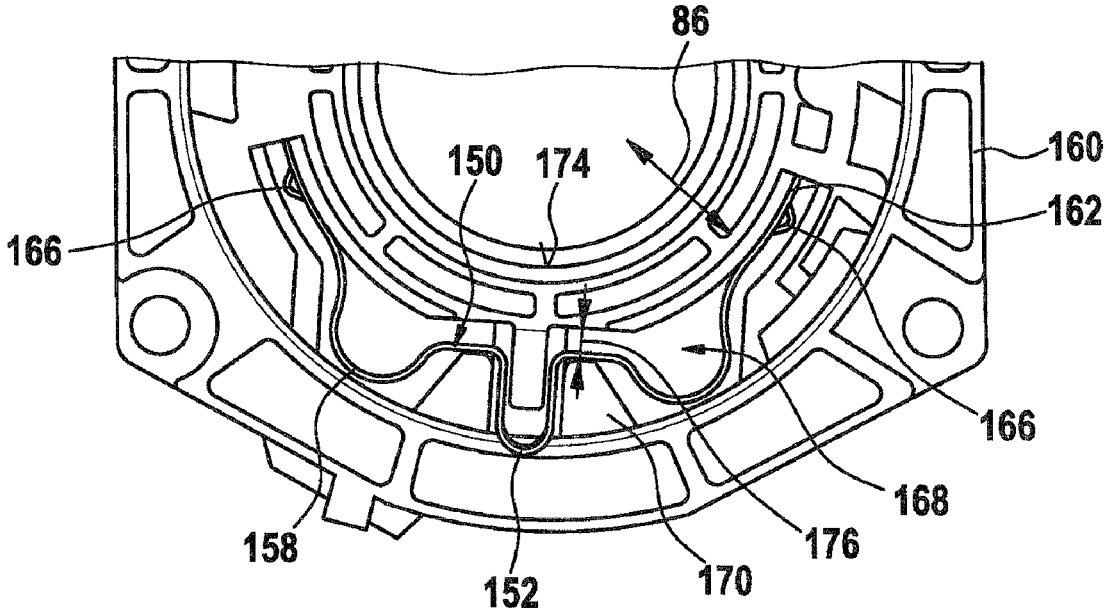

An alternative design of orientation spring 150 is shown in FIGS. 9*a* and 9*b*. A central, U-shaped subregion 152 of orientation spring 150 has crimping 156—which extends in circumferential direction 76 (FIG. 10*a*)—in the form of notches in curves 154, which reinforce subregion 152. In addition, a further, U-shaped region 158 is located in circumferential direction 76 to the left and right of subregion 152 to support spring action that occurs when a guard 18 is installed on a flange 160 of a hand-held power tool 10. Enlarged fastening regions 164 for attachment with flange 160 are located on ends 162 of orientation spring 150, in circumferential direction 76. To this end, crimping 166 that is also formed using notches and that extends perpendicularly to circumferential direction 76 is stamped in fastening regions 164. Fastening regions 164 extend perpendicularly to circumferential direction 76 and perpendicularly to a radial direction 86 (FIGS. 10*a* and 10*b*). For attachment with flange 160, orientation spring 150 is inserted into a receiving region 168 of flange 160, and flange 160 is deformed plastically in regions of attachment regions 164 of orientation spring 150, and it is pressed onto orientation spring 150. Via integrally formed crimping 166 in fastening regions 164, orientation spring 150 is fixedly connected via ends 162 with flange 160. Receiving region 168 extends in circumferential direction 76 on flange 160 (FIGS. 10*a* and 10*b*). Additional retaining elements 170 of flange 160, which are located in circumferential direction 76 to the left and right of central, U-shaped subregion 152 of orientation spring 150, hold orientation spring 150 in an advantageous starting position that enables guard 18 to be installed on flange 160 and prevents orientation spring 150 from becoming damaged. In addition, retaining elements 170, together with a radially inwardly directed wall 174 of flange 160, limit spring travel 176 of orientation spring 150 in a radial direction 86 during installation of guard 18.

Figure 11A:
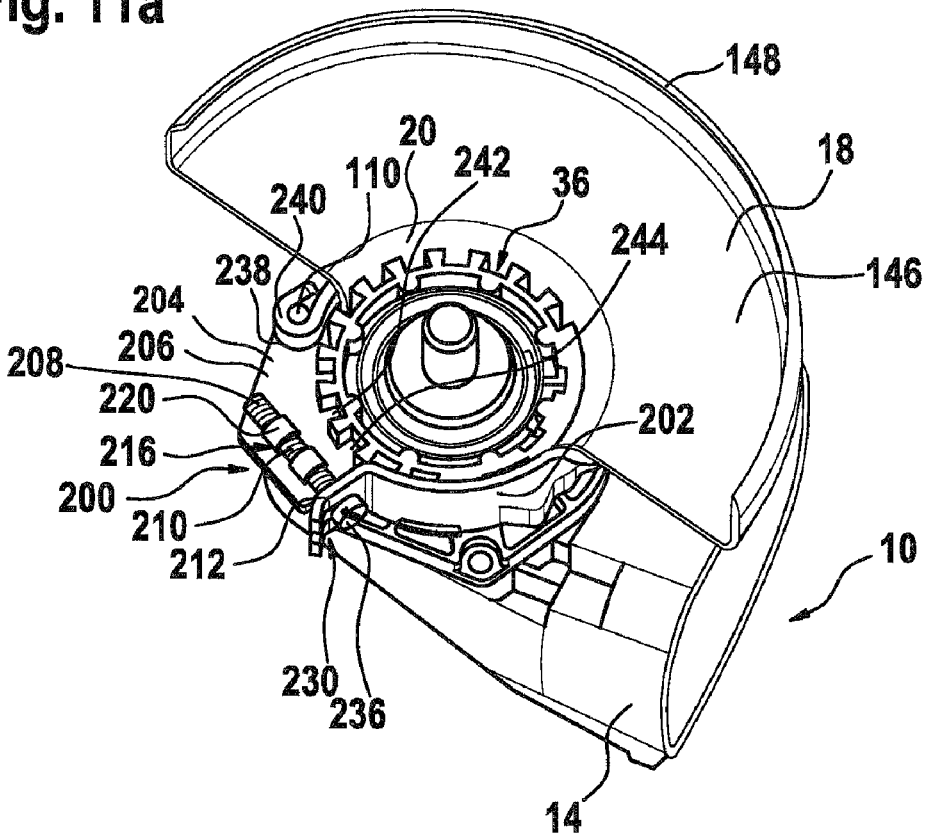
FIGS. 11*a*, 11*b* show a subregion of the hand-held power tool with an installed guard, with an alternative closing element, in a perspective view.
Figure 11B:
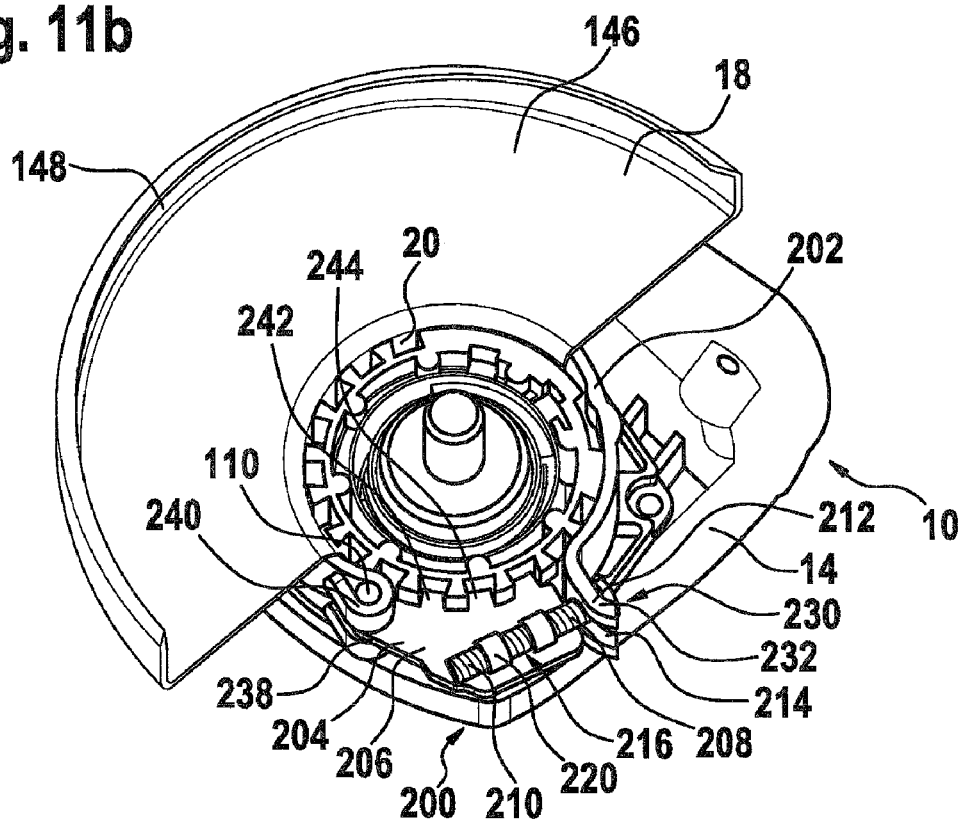
Figure 12A:
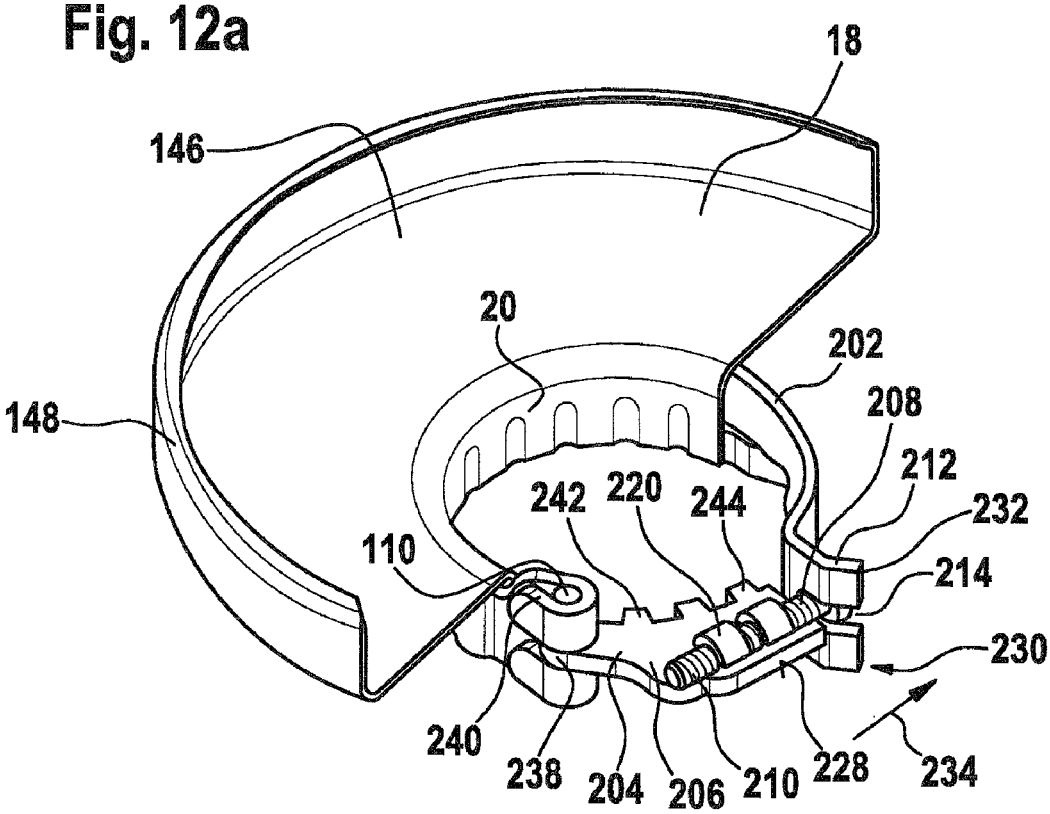
FIGS. 12*a*, 12*b* show the guard in FIGS. 9*a* and 9*b* with the alternative closing element, in a perspective view and in a side view.
Figure 12B:
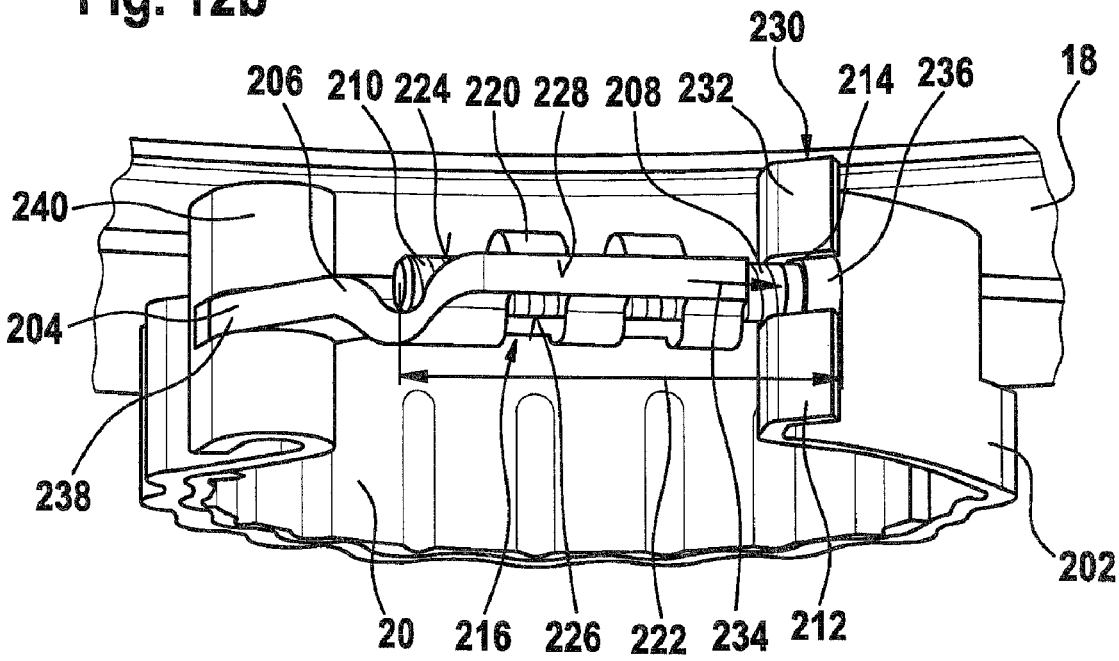

FIGS. 11*a* and 12*b* show a clamping system 200 that is an alternative to toggle joint system 44 shown in FIGS. 2 through 8. Clamping system 200 includes a clamping band 202, a rocker 206 formed by a clamping part 204, and clamping means 210 formed by a screw 208. An end 212 of clamping band 202 is bent radially outwardly and is provided with a recess 214 for receiving screw 208. Rocker 206 includes a receiving region 216 with a counter-thread to screw 208, thereby enabling a guard 18 to be attached to flange 16 in a clamping position using screw 208, rocker 206, and clamping band 202. The thread is formed in pressed-out regions 220 of rocker 206, which are arched in opposite directions and in a flush manner, and which are formed by subpieces. The subpieces of receiving region 216 are located on opposite sides 224, 226 of screw 208 along a longitudinal extension 222 of receiving region 216 in an alternating pattern and in the manner of semi-arches (FIG. 12*b*). The counter-thread is formed in the center, in a side 228 of rocker 208 that determines the lamella thickness. To prevent screw 208 from accidentally moving out of recess 214 when guard 18 is installed, end 212 includes a screw retention 230, in that end regions 232 of end 212 are bent in direction 234 of a screw head 236 of screw 208 such that it is fixed in position in radial direction 86 inside recess 214. Once guard 18 has been installed on flange 16, it may be removed simply by loosening screw 208 until it—together with rocker 206—may be folded out of clamping band 202 and/or recess 214 with screw retention 230. A rotation point and/or support point of rocker 206 is located on an end 238 of rocker 206 that faces away from screw 208, and/or on end 240 of clamping band 202 that faces rocker 206. To this end, recess 214 of end 212 of clamping band 202 is designed open to the outside, in radial direction 86, so that screw 208 may be folded—together with rocker 206—outwardly, and so that undercut-engagement means 242 of rocker 206 formed by teeth 244 may release a counter-toothed profile 36 of flange 16 formed by recesses 38. Clamping system 200 is closed by performing the steps described above in the reverse order.

Figure 13:
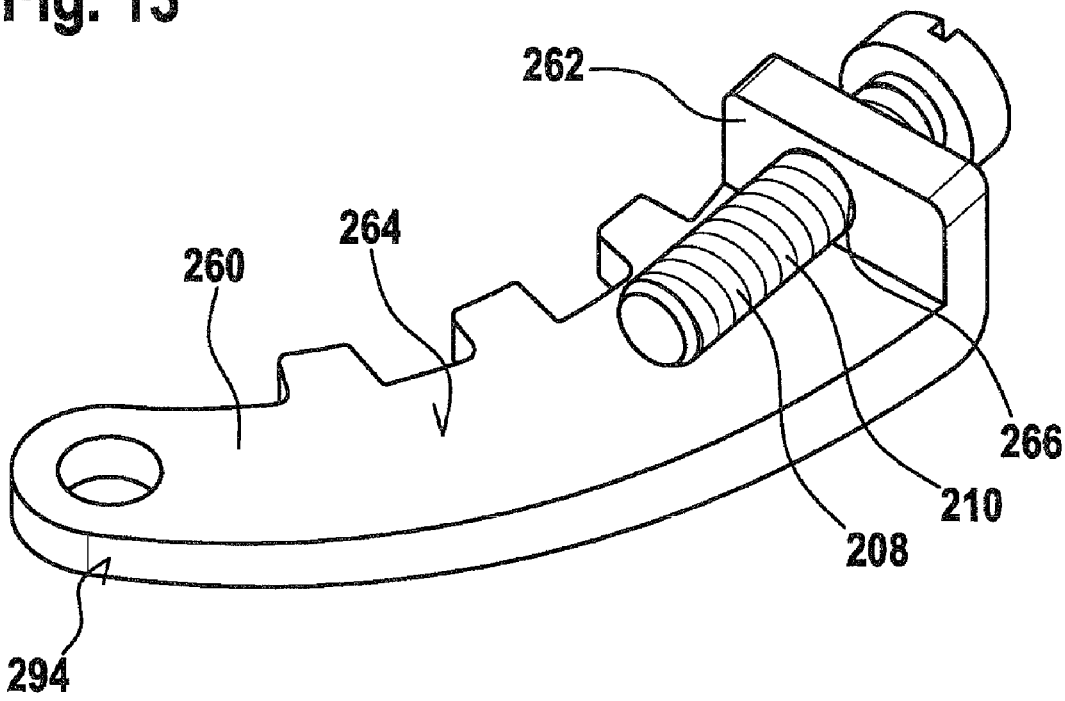
FIG. 13 shows an alternative design of a rocker, in a perspective view.

FIG. 13 shows a design of rocker 260 that is an alternative to the design shown in FIGS. 11*a* through 12*b*. Rocker 260 includes an end region formed by an end tab 262, which extends on rocker 260 perpendicularly to a main extension surface 264 of rocker 260. This end region includes a recess 266 with a thread for a clamping means 210 formed by a screw 208, thereby enabling a guard 18 to be attached to a flange 16 of a hand-held power tool 10 using rocker 260, screw 208, and a clamping band 202. As an alternative, instead of recess 266 for receiving screw 208, a nut may be located in the end region.

FIG. 14 shows a rocker 282, which is formed by a clamping part 280, and which is an alternative to the design shown in FIGS. 11*a* through 13. Rocker 280 includes two semi-rockers 284, 286, each of which has half the thickness 288 of rocker 282. Rocker 282 also includes a receiving region 290 with a thread 292 for a clamping means 210, which is formed by a screw 208. Semi-rockers 284, 286 in receiving region 290 are designed as semi-arches, to receive screw 208. Thread 292 is formed in the center, in a side 294 of rocker 282 that determines a lamella thickness. It is also possible to form semi-rockers 284, 286 simply by embossing a desired pitch shape and/or bearing that matches that of screw 208 and/or clamping means 210.

What is claimed is:

1. A hand-held power tool for rotatably driving a disk-shaped tool, comprising:

a motor to produce a drive torque to drive said disk-shaped tool;

a spindle to transfer said drive torque from said motor to said disk-shaped tool for rotatably driving said disk-shaped tool around a spindle axis of said spindle;

a machine housing that comprises a flange embodied as a machine neck that is fixedly connected to said machine housing; and a guard for covering said disk-shaped tool;

wherein said guard comprises a guard neck embodied as a guard collar and an annular clamping band that is located on said guard collar and that comprises a clamping means for detachably clamping said guard to said machine neck, the clamping band extends in annular fashion from a first end around an arc to a second end, wherein there is an open area between the first end and second end void of the clamping band, the clamping band also having a through hole along the arc portion, wherein said clamping band is tightenable along a circumferential direction of said guard collar using said clamping means, wherein said circumferential direction extends—in a mounted state of said guard—in a plane perpendicular to said spindle axis of said spindle, wherein said clamping means comprises at least one pivotal clamping lever that comprises at least two sets of engagement means embodied as two toothed profiles, wherein said flange embodied as said machine neck comprises a toothed profile embodied as recesses extending on a circumference of said machine neck facing said guard collar in a mounted state of said guard, wherein said recesses of said machine neck are correspondingly formed to said toothed profile of said at least one clamping lever, wherein one of said toothed profiles of said at least one clamping lever is provided for engaging into the open area of the clamping band and into said recesses of said machine neck and the other of said toothed profiles of said at least one clamping lever is provided for engaging into the through hole of the clamping band and into said recesses of said machine neck to form an anti-rotation lock between said guard and said machine neck in a form of a profiled structure, and wherein said clamping means, in its clamping position, is connected in a form-fit manner with said machine neck and, in its releasing position, is disengaged from the form-fit connection with said machine neck.

2. The hand-held power tool as recited in claim 1, wherein said clamping means comprises a first clamping lever and a second clamping lever which are pivotally connected to each other via a bearing element, wherein said first clamping lever is embodied as a rocker and wherein said second clamping lever is embodied as a latch.

3. The hand-held power tool as recited in claim 2, wherein the rocker and the latch are provided with several holes (50) in order to reduce weight and improve their grippability.

4. The hand-held power tool as recited in claim 2, wherein the first damping lever and the second clamping lever together form a toggle joint system.

5. The hand-held power tool as recited in claim 4, wherein said clamping band comprises at least two clamping band elements, which are provided for adjusting said clamping force of said toggle joint system using said adjusting element.

6. The hand-held power tool as recited in claim 1, wherein said clamping band comprises a bent, projecting semi-loop and an adjusting element that passes through said semi-loop to adjust a clamping force of said clamping band by using said adjusting element.

7. The hand-held power tool as recited in claim 1, wherein said guard collar comprises embossed regions to form embossments along a circumferential direction of said guard collar on a side of said guard collar facing said clamping band, wherein said embossments are provided to engage In recesses of said clamping band which correspond to said embossments and which are located on a side of said clamping band facing said guard collar—in a mounted state of the clamping band on said guard collar.

8. The hand-held power tool as recited in claim 1, wherein said toothed profile of said at least one clamping lever and said corresponding recesses generate a clamp tightening and/or retightening effect when rotational forces act on said guard.

9. The hand-held power tool as recited in claim 1, further comprising an orientation spring, wherein said orientation spring is located on said flange embodied as said machine neck, to which an indentation of said clamping band extending in a radial direction of said clamping band is assigned, wherein said indentation serves as guidance when said guard is inserted axially onto said machine neck.

10. The hand-held power tool as recited in claim 1, wherein, when said guard is rotated in a mounted state, said orientation spring interacts in an overlatching manner with said embossments of said guard collar.

* * * * *